United States Patent [19]

Saulgeot

[11] Patent Number: 4,512,725

[45] Date of Patent: Apr. 23, 1985

[54] ROTARY VACUUM PUMP

[75] Inventor: Claude Saulgeot, Veyrier-du-Lac, France

[73] Assignee: Compagnie Industrielle des Telecommunications Cit-Alcatel, Paris, France

[21] Appl. No.: 467,045

[22] Filed: Feb. 16, 1983

[30] Foreign Application Priority Data

Feb. 16, 1982 [FR] France ..... 82 02496

[51] Int. Cl.[3] ..... F04B 17/00; F04B 39/06; H02K 9/00

[52] U.S. Cl. ..... 417/366; 417/372; 417/424; 310/52; 310/55; 415/90; 415/169 A

[58] Field of Search ..... 415/90, 96, 169 A, 180; 310/55, 57, 52; 277/3, 134; 417/423 A, 423 R, 424, 366, 372

[56] References Cited

U.S. PATENT DOCUMENTS

| | | | |
|---|---|---|---|
| 1,230,206 | 6/1917 | Niemayer | 417/423 A |
| 1,657,550 | 1/1928 | Saathoff | 310/55 |
| 3,355,179 | 11/1967 | McGrew | 277/134 |
| 3,969,042 | 7/1976 | Bächler | 415/90 |
| 4,332,522 | 6/1982 | Saulgeot | 419/90 |

FOREIGN PATENT DOCUMENTS

| | | | |
|---|---|---|---|
| 2310481 | 12/1976 | France | 415/90 |
| 2446934 | 1/1979 | France . | |

*Primary Examiner*—William L. Freeh
*Assistant Examiner*—T. Olds
*Attorney, Agent, or Firm*—Sughrue, Mion, Zinn, Macpeak, and Seas

[57] ABSTRACT

A hard vacuum pump of the type having a pump body (4) to which a multi-stage stator (3) and a multi-stage rotor (2) mounted on a shaft (1) are connected, said shaft (1) being driven by a motor and rotating in at least two ball bearings (5, 6) disposed in a sleeve (18) formed by an extension of said pump body (4), a dynamic molecular seal (7) being set on said shaft (1) at the body end of the sleeve (18), wherein the opposite end (11) of the sleeve (18) is closed, a nozzle (8) communicating with an outside source of gas being provided at said closed end (11), said pump body (4) also being connected to an exterior primary vacuum pump whereby said ball bearings (5, 6), and the rotor (9) of said motor are permanently swept by said gas entering via said nozzle and leaving via said dynamic seal, said gas flowing at a pressure intermediate between atmospheric pressure and the pump discharge pressure.

The invention is used in microelectronics techniques.

6 Claims, 1 Drawing Figure

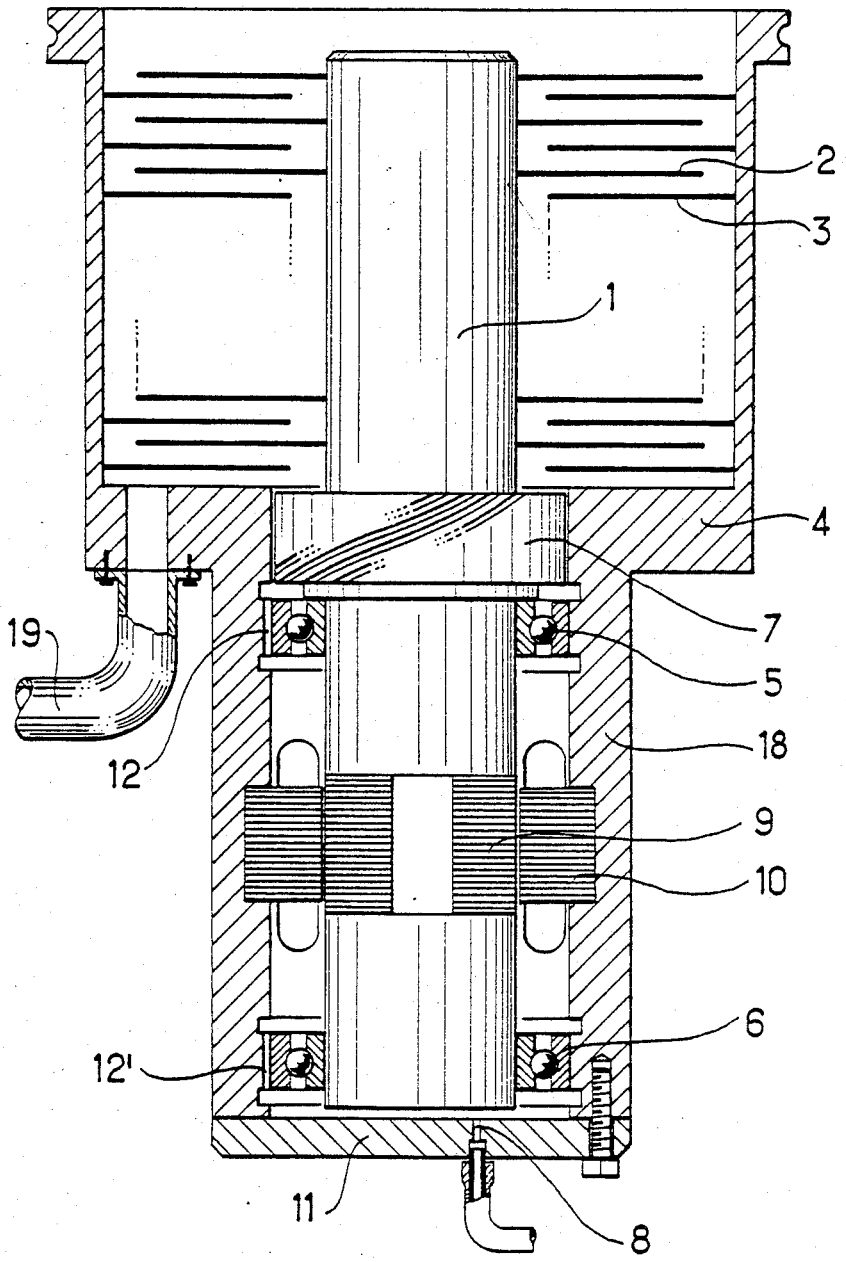
2
3
1
4
7
5
19
12
18
9
10
6
12'
11
8

ROTARY VACUUM PUMP

The present invention relates to a rotary hard vacuum pump such as a molecular or a turbomolecular vacuum pump.

BACKGROUND OF THE INVENTION

It is known that hard vacuum pumps which operate on a molecular or a turbomolecular basis have rotors which rotate at high speed in stationary stators.

The molecule transport effect is set up at the periphery of the rotor as it rotates at high speed by reflecting a large proportion of these molecules in the zone of the stator which is adjacent to the rotor; the stator then returns a portion of the molecules to the part of the rotor located below and so on, such that the rotor and stator assembly has a high pressure ratio between the partial gas pressure at the discharge end and the pressure of the same gas at the suction end.

The need for a high rotor rotation speed gives rise to a serious problem in the case of bearings which must be installed in a chamber in which a vacuum is set up.

Known bearings lubricated with oil or grease operate in a primary vacuum and a known motor is used which also operates in a vacuum. However, pumps thus equipped have a number of disadvantages:

In particular, it is difficult to lubricate the ball bearings and other related components properly and to cool them sufficiently.

Further, it is practically impossible to prevent oil and grease from rising up to the pump suction zone level.

Published French patent application No. 2 446 934 describes a hard vacuum pump which makes it possible to remedy these difficulties.

It includes a rotor driven by a motor located outside the pumping chamber and fixed thereto by a drive shaft sealed by a grooved dynamic molecular seal. In said pump, the shaft is supported firstly by an outer bearing located outside the pumping chamber and secondly by an inner bearing located inside the pumping chamber and lubricated with grease.

The inner bearing is located between the grooved dynamic molecular seal and a viscous dynamic molecular seal interposed between the inner bearing and the outer bearing. A longitudinal groove makes the two surfaces of the inner bearing communicate with each other.

This solves the problem of cooling the bearings and the drive motor.

Indeed, the ball bearings located in the empty zone are easily cooled by conduction along the shaft, one of whose ends is easily cooled since it is in contact with the outside atmosphere. Likewise, the rotor and the stator of the motor are cooled by conventional means since these two components are in contact with the outside atmosphere, as is the outer bearing.

However, when the pumped gases are particularly corrosive, the position of the ball bearings relative to the flow of pumped gas is not very good despite the location of the longitudinal groove which prevents gas from flowing directly through the bearing and further, since one end of the movable assembly is located in a very low pressure chamber and the other end thereof is subjected to atmospheric pressure, a high axial load results therefrom and is borne by one of the two bearings. This limits the service life of the pump.

Preferred embodiments of the present invention mitigate these disadvantages while also providing proper cooling of the bearings and of the motor.

SUMMARY OF THE INVENTION

The invention therefore relates to a hard vacuum pump of the type having a pump body to which a multi-stage stator and a multi-stage rotor mounted on a shaft are connected, said shaft being driven by a motor and rotating in at least two ball bearings disposed in a sleeve formed by an extension of said pump body, a dynamic molecular seal being set on said shaft at the body end of the sleeve, wherein the opposite end of the sleeve is closed, a nozzle communicating with an outside source of gas being provided at said closed end, and said pump body being connected to an exterior primary vacuum pump whereby said ball bearings and the rotor of said motor are permanently swept by said gas entering via said nozzle and leaving via said dynamic seal, said gas flowing at a pressure intermediate between atmospheric pressure and the pump discharge pressure.

BRIEF DESCRIPTION OF THE DRAWING

Other features and advantages of the invention become apparent from the following description given merely by way of a non-limiting illustration with reference to the accompanying drawing which illlustrates a vertical cross-section of one embodiment of a hard-vacuum rotary pump.

MORE DETAILED DESCRIPTION

As illustrated in the attached FIGURE, the pump conventionally has a pump body 4 to which a multi-stage stator 3 is connected as is a multi-stage rotor 2 installed on a drive shaft 1.

The pump body 4 is open at its upper end to hollow it to be connected to the chamber (not illustrated) in which a hard vacuum must be set up. The body 4 has an extension at its lower portion which extension constitutes a sleeve 18 closed at its lower end by an end plate 11.

The shaft 1 rotates in the body 4 on ball bearings 5 and 6 located at the upper and lower portions respectively of said sleeve 18 and it is driven by means of an electric motor whose rotor and stator are referenced 9 and 10 respectively. The motor is located between the bearings 5 and 6 but it could also be installed level with the lower portion of the shaft 1.

Further, a grooved dynamic molecular seal 7 is located on the shaft 1 at the upper portion of the sleeve 18, above the ball bearing 5. Such a dynamic molecular seal provides sealing along the shaft 1 and separates the ball bearings 5 and 6 as well as the rotor 9 of the electric motor from the pumping zone delimited by the body 4. The pumping zone also communicates with an exterior primary vacuum pump (not illustrated) via a pipe 19. An end plate 11 is provided with a nozzle 8 which is suitable for letting in air or neutral gas from outside the end plate.

Further, the two surfaces of each of the ball bearings 5 and 6 can be made to communicate with each other via passages 12 and 12' provided in the wall of the sleeve 18.

In this way, the flow of said outside air or neutral gas permanently sweeps across components such as, in particular, the ball bearings 5 and 6 and the rotor 9 of the motor at a pressure of the order of a few tens of Torrs, i.e. a pressure between atmospheric pressure and the pump discharge pressure, such a gas flow being pumped by the primary pump connected to the pipe 19, said pump also providing for discharge from the molecular pumping cell.

The advantages of such a pump structure are as follows:

In the first instance migration of corrosive gas from the chamber to be evacuated is avoided by the gas flow and consequently the ball bearings as well as the lubricant are protected against any danger of corrosion.

Besides it should be noted that to make the pump completely invulnerable to corrosion, it is sufficient to make the rotor and the stator of the motor from suitably resistant substances. This does not give rise to any particular problem.

Further, the lubricant is kept at a pressure such that its rate of evaporation is at a minimum. It is therefore possible to avoid periodically renewing the lubricant of the ball bearings. Further, and contrary to the cited prior art document, the end of the movable unit located on the further end from the rotor is no longer subjected to atmospheric pressure but only to a pressure of a few tens of Torrs, the axial load borne by the bearings is therefore much less.

Also, gas flow prevents migration of the lubricant towards the pump suction end thus imparting the required qualities to said pump in accordance with the invention for it to operate as a so-called "dry-pump".

Further, in comparison with conventional pumps in which the electric motor and the bearings are subjected to a pressure of about $10^{-2}$ Torrs, the pump in accordance with the invention allows more efficient cooling since the heating zone located level with the ball bearings and with the electric motor is subjected to a pressure of a few tens of Torrs.

In this way, better heat transfer is provided.

The invention is advantageously used in all types of molecular vacuum pumps and in particular in pumps used in microelectronics techniques.

Of course, the invention is in no way limited to the embodiment described and illustrated which is given only by way of example.

In particular, for example, the grooved dynamic molecular seal 7 can be replaced by a dynamic molecular seal of very simple design and can be obtained simply by two suitably associated opposite surfaces with or without grooves, the state of the surfaces then acting as grooves.

I claim:

1. A hard vacuum pump of the type having a pump body forming a pump chamber, a multi-stage stator and a multi-stage rotor mounted on a shaft carried by said body, a motor driving said shaft, at least two ball bearings disposed in a sleeve formed by an extension of said pump body, said bearings supporting said shaft, a dynamic molecular seal set on said shaft at the pump body end of the sleeve, the improvement wherein the dynamic molecular seal is disposed between the bearings and the pump chamber, the opposite end of the sleeve from said body end is closed, an inlet nozzle of small diameter communicating with an outside source of gas at atmospheric pressure being provided at said closed end, and means for connecting said pump body to an exterior primary vacuum pump; whereby said ball bearings and the rotor of said motor are permanently swept by gas at a pressure on the order of a few tens of Torrs entering via said nozzle and leaving via said dynamic seal, thereby reducing the axial load borne by the bearings.

2. A pump according to claim 1, wherein said sleeve has passages passing through it for communicating the ends of said ball bearings with each other.

3. A pump according to claim 1, wherein said outside source of gas is the atmosphere.

4. A pump according to claim 1, wherein said outside source of gas is a source of netural gas.

5. A pump according to claim 1, wherein said motor is disposed between said ball bearings.

6. A pump according to claim 1, wherein said motor is disposed level with the lower end of said shaft.

* * * * *